US010352140B2

(12) United States Patent
Parlin et al.

(10) Patent No.: US 10,352,140 B2
(45) Date of Patent: Jul. 16, 2019

(54) FORMING MULTILATERAL WELLS

(71) Applicant: Halliburton Energy Services, Inc., Houston, TX (US)

(72) Inventors: Joseph DeWitt Parlin, Plano, TX (US); Mario Carlos Vento-Zegarra, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 186 days.

(21) Appl. No.: 15/307,080

(22) PCT Filed: May 29, 2014

(86) PCT No.: PCT/US2014/038169
§ 371 (c)(1),
(2) Date: Oct. 27, 2016

(87) PCT Pub. No.: WO2015/183231
PCT Pub. Date: Dec. 3, 2015

(65) Prior Publication Data

US 2017/0067321 A1 Mar. 9, 2017

(51) Int. Cl.

| | |
|---|---|
| ***E21B 43/14*** | (2006.01) |
| ***E21B 41/00*** | (2006.01) |
| ***E21B 7/06*** | (2006.01) |
| ***E21B 43/26*** | (2006.01) |

(52) U.S. Cl.
CPC ..... *E21B 43/14* (2013.01); *E21B 7/061* (2013.01); *E21B 41/0042* (2013.01); *E21B 43/26* (2013.01)

(58) Field of Classification Search
CPC ..... E21B 41/0042; E21B 33/12; E21B 43/14; E21B 43/26; E21B 7/061; E21B 23/002; E21B 23/14; E21B 23/08
See application file for complete search history.

(56) References Cited

U.S. PATENT DOCUMENTS

| | | | | |
|---|---|---|---|---|
| 5,318,121 A * | 6/1994 | Brockman | ..... | E21B 7/061 166/117.6 |
| 5,353,876 A * | 10/1994 | Curington | ..... | E21B 7/061 166/313 |
| 5,474,131 A * | 12/1995 | Jordan, Jr. | ..... | E21B 7/061 166/313 |
| 5,730,221 A | 3/1998 | Longbottom et al. | | |
| 5,787,978 A | 8/1998 | Carter et al. | | |

(Continued)

FOREIGN PATENT DOCUMENTS

| | | |
|---|---|---|
| WO | 2014084834 A1 | 6/2014 |
| WO | 2014137315 A1 | 9/2014 |

(Continued)

*Primary Examiner* — Michael R Wills, III
(74) *Attorney, Agent, or Firm* — Scott Richardson; Parker Justiss, P.C.

(57) ABSTRACT

In one example of forming multilateral wells in unconventional reservoirs, a subterranean zone is drilled using a drilling rig to form a main wellbore. Using the drilling rig, the subterranean zone is drilled to form a lateral wellbore off the main wellbore. The drilling rig is removed after forming a multilateral well including the main wellbore and the lateral wellbore. Using a fracturing system, a fracture treatment is performed on the lateral wellbore.

17 Claims, 12 Drawing Sheets

(56) References Cited

U.S. PATENT DOCUMENTS

| | | | | |
|---|---|---|---|---|
| 5,845,707 | A * | 12/1998 | Longbottom | E21B 7/061 166/50 |
| 6,712,148 | B2 | 3/2004 | Fipke et al. | |
| 6,907,930 | B2 * | 6/2005 | Cavender | E21B 41/0042 166/242.3 |
| 7,905,279 | B2 | 3/2011 | Hart et al. | |
| 8,210,270 | B2 | 7/2012 | Renshaw et al. | |
| 8,220,547 | B2 | 7/2012 | Craig et al. | |
| 8,376,066 | B2 | 2/2013 | Steele et al. | |
| 9,260,945 | B2 * | 2/2016 | Lajesic | E21B 7/061 |
| 2002/0074120 | A1 | 6/2002 | Scott | |
| 2003/0075333 | A1 | 4/2003 | Vercaemer et al. | |
| 2005/0121190 | A1 * | 6/2005 | Oberkircher | E21B 41/0035 166/250.1 |
| 2007/0158073 | A1 | 7/2007 | Green | |
| 2011/0018629 | A1 | 1/2011 | Jeon et al. | |
| 2011/0114320 | A1 | 5/2011 | Sponchia et al. | |
| 2014/0102710 | A1 * | 4/2014 | Benson | E21B 43/08 166/313 |
| 2016/0245046 | A1 * | 8/2016 | Butler | E21B 23/002 |

FOREIGN PATENT DOCUMENTS

| | | | |
|---|---|---|---|
| WO | 2015012847 | A1 | 1/2015 |
| WO | 2015183231 | A1 | 12/2015 |

* cited by examiner

FORMING MULTILATERAL WELLS

CROSS-REFERENCE TO RELATED APPLICATION

This application is the National Stage of, and therefore claims the benefit of, International Application No. PCT/US2014/038169 filed on May 29, 2014, entitled "Forming Multilateral Wells," which was published in English under International Publication Number WO 2015/183231 on Dec. 3, 2015. The above application is commonly assigned with this National Stage application and is incorporated herein by reference in its entirety.

TECHNICAL FIELD

This disclosure relates to forming multilateral wells.

BACKGROUND

Hydrocarbons (e.g., oil, natural gas, combinations of them, or other hydrocarbons) can be produced through relatively complex wellbores traversing a subterranean zone (e.g., a formation, a portion of a formation, or multiple formations). Some wells, known as multilateral wells, include the main wellbore and one or more lateral wellbores, each of which extends at an angle from the main wellbore. Performing a fracture treatment in either the main wellbore or in one of the lateral wellbores can include isolating the remaining wellbores from the wellbore to be fractured. Such isolation and fracture treatment can sometimes necessitate multiple trips in and out of the multilateral well. The multiple trips can result in multilateral well operations being inefficient and/or expensive.

DESCRIPTION OF DRAWINGS

Like reference symbols in the various drawings indicate like elements.

DETAILED DESCRIPTION

Figure 1A:
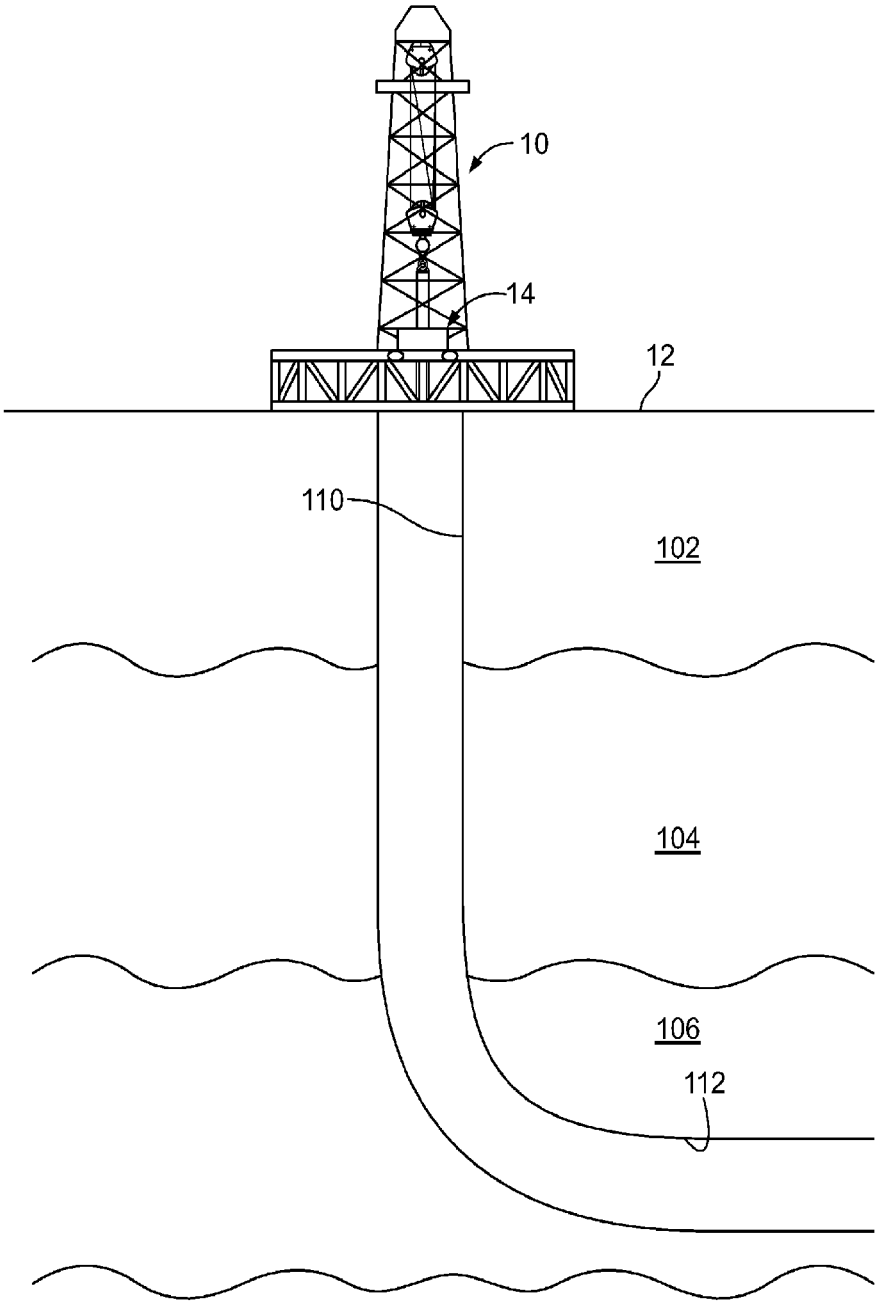
FIGS. 1A and 1B are schematic diagrams showing a well site with an example drilling rig to drill an example multilateral well.

This disclosure describes forming multilateral wells by providing hydraulic isolation of the main wellbore and each lateral wellbore while limiting the additional trips associated with creating the multilateral junctions. In some implementations for forming a multilateral well, a drilling rig can be used to drill a subterranean zone to form a main wellbore and to form one or more lateral wellbores off the main wellbore. To form a lateral wellbore off the main wellbore, a whipstock is positioned in the main wellbore at or below a location at which the lateral wellbore is to be formed. A lower portion of the whipstock is enlarged relative to an upper portion resulting in the whipstock being a wedge in the main wellbore. When a drill bit attached to tubing is lowered into the main wellbore, the whipstock deflects the drill bit laterally off the axis of the main wellbore to drill the lateral wellbore. The whipstock can then be retrieved from the main wellbore using a retrieval mechanism included in the whipstock. After the main wellbore and all the lateral wellbores in the multilateral well have been formed, the drilling rig can be removed. Subsequently, a fracture treatment can be performed by selectively accessing either the main wellbore or one of the lateral wellbores. A downhole deflector tool can be implemented, as described below, to selectively access either the main wellbore or a lateral wellbore.

Implementing the techniques described here can enable limiting the number of trips to perform well operations in multilateral wells. Doing so can make multilateral wells an economically attractive option, e.g., in unconventional reservoirs in which fracking is necessary. For example, by drilling the main wellbore and the lateral wellbores before performing fracture treatments, the drilling rig used to drill the wellbores can be relinquished resulting in significant cost savings that would otherwise be incurred by retaining possession of the drilling rig. Sometimes, the main wellbore is drilled, fractured, and sealed before performing a fracture treatment in a lateral wellbore. Doing so can prevent production from the main wellbore. Implementing the techniques described here can negate the need to seal the main wellbore before performing the fracture treatment on a lateral wellbore. Further, the techniques described here can allow the multilateral well operator to access any of the wellbores, i.e., a lateral wellbore or the main wellbore, to first perform the fracture treatment while sealing off the remaining wellbores in the multilateral well. In other words, the multilateral well operator need not first perform the fracture treatment on the main wellbore and then perform the fracture treatment on a lateral wellbore. Instead, the multilateral well operator can choose to first perform the fracture treatment on a lateral wellbore and then perform the fracture treatment on the main wellbore. The operator may opt to produce either the main wellbore or the lateral wellbore for some significant period of time before producing the other wellbore. The techniques described here would allow for that delayed production without the need to re-mobilize the drilling rig. Further, the techniques described here allow for access to either wellbore, or both, for follow-on activities such as re-stimulation or clean-out in order to restore production or plugging or closing-off zones that are no longer producing, without the need to remobilize the drilling rig in order to re-enter the lateral well bore.

Figure 1B:
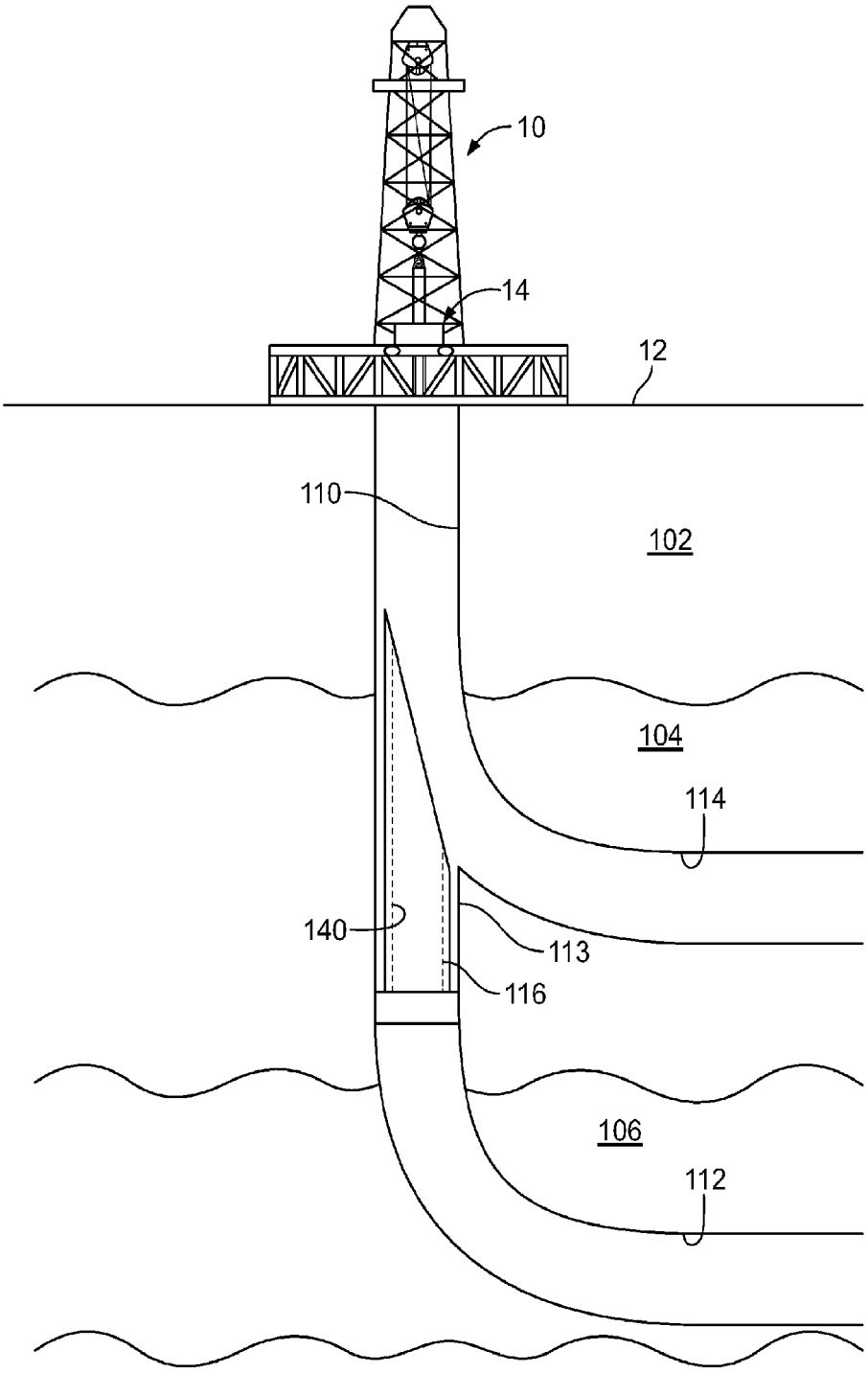
Figure 1C:
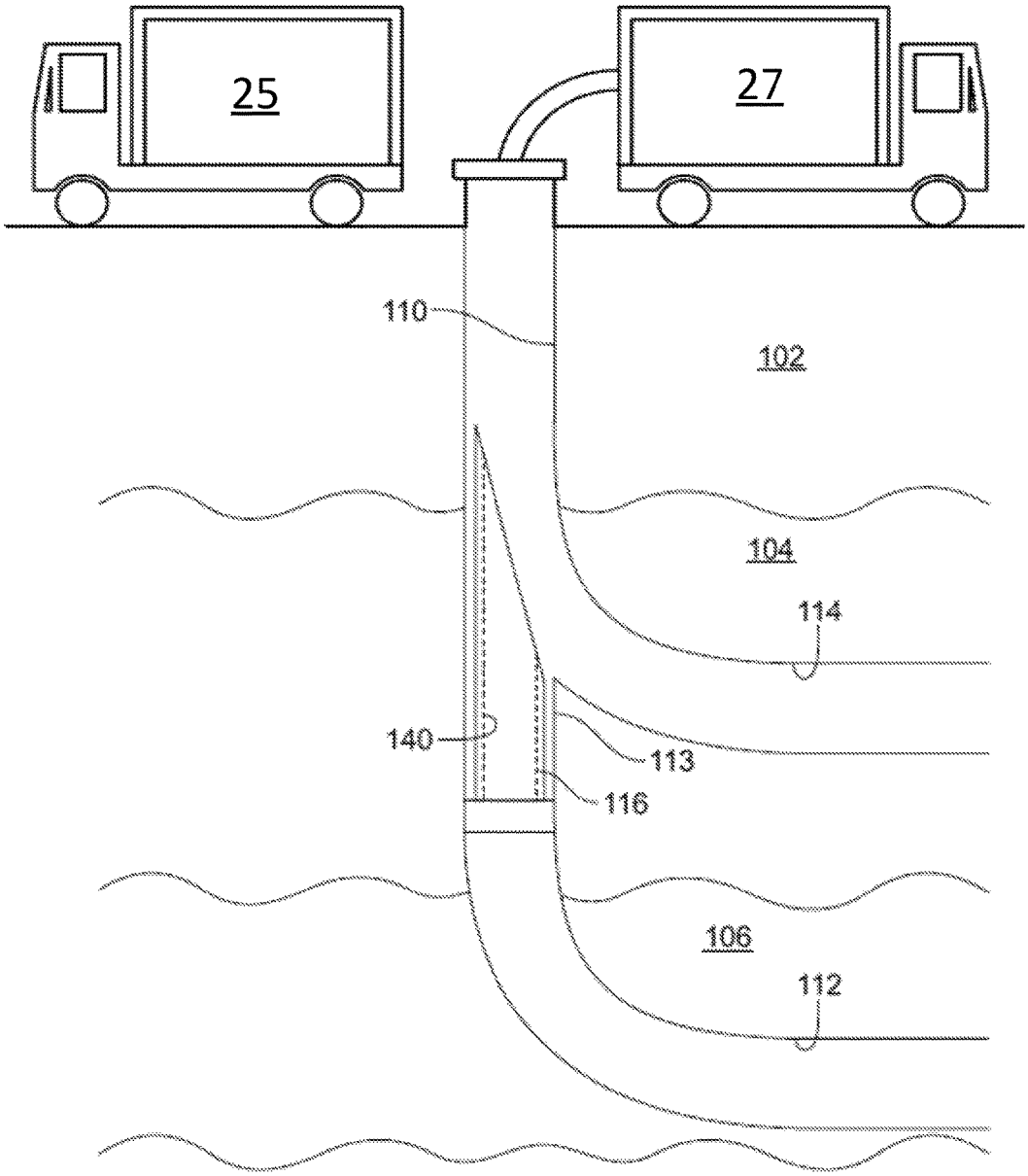
FIG. 1C is a schematic diagram showing a fracturing system implemented at the well site of FIGS. 1A and 1B.
Figure 2A:
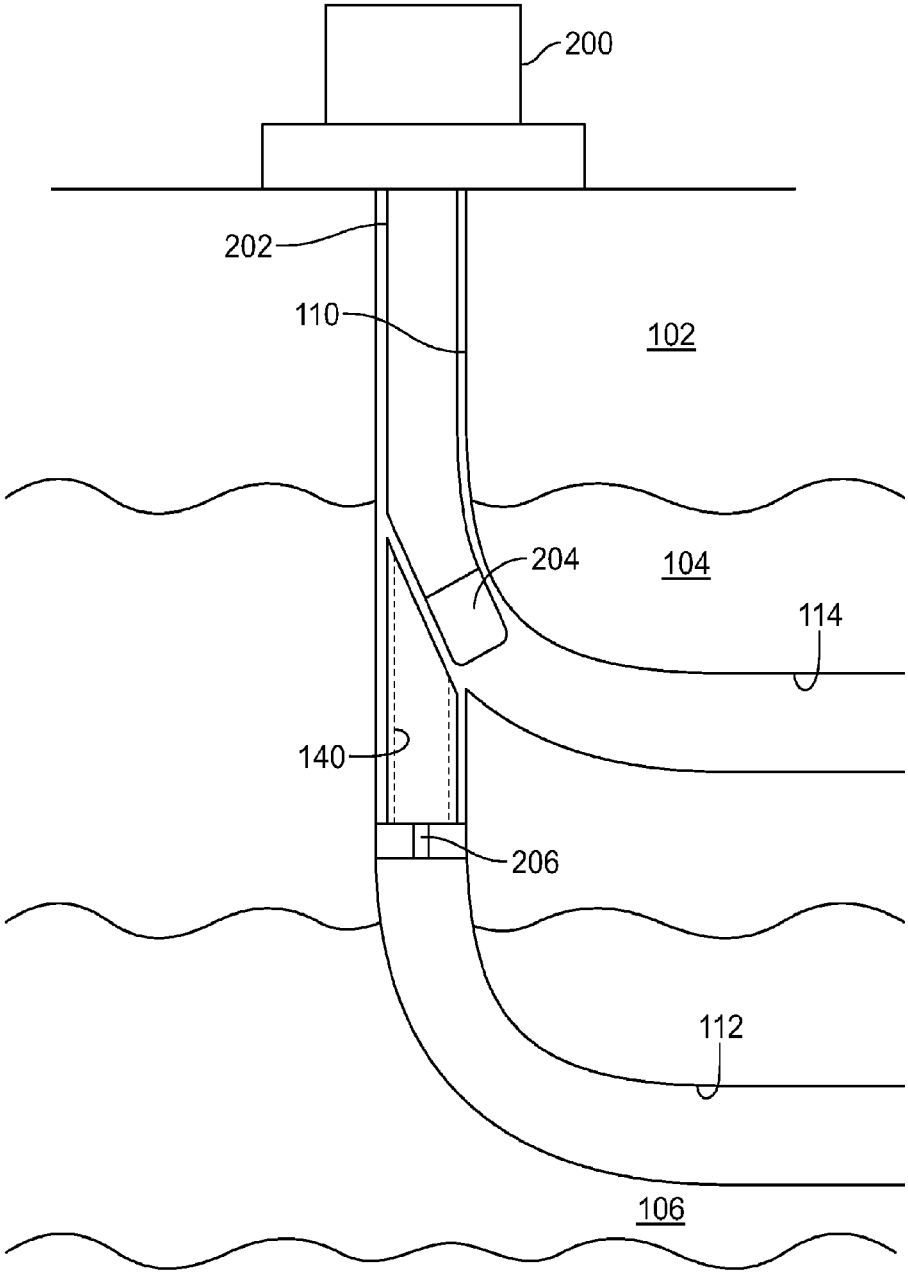
FIGS. 2A and 2B are schematic diagrams showing the well site with an example service rig to perform well operations on the example multilateral well.
Figure 2B:
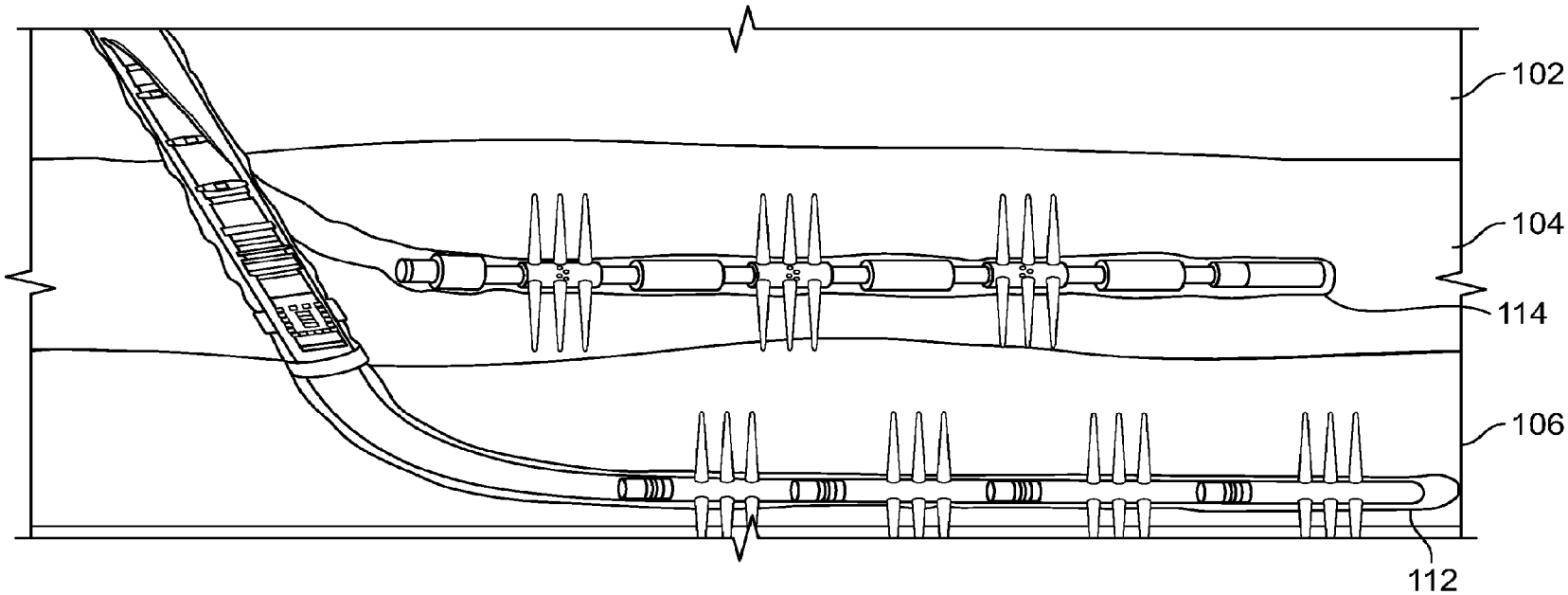
Figure 3:
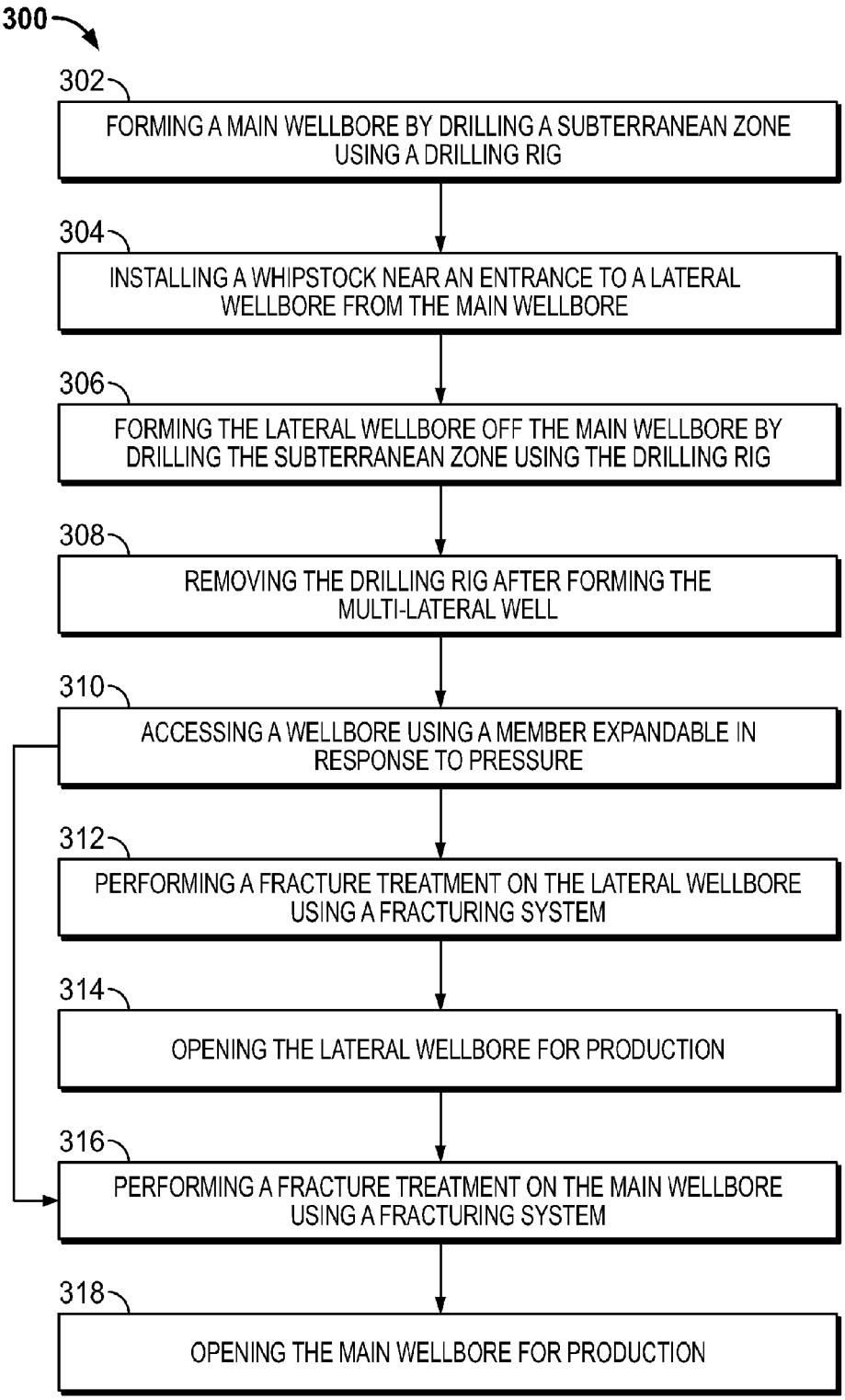
FIG. 3 is a flowchart of an example process to form a multilateral well.

FIGS. 1A and 1B are schematic diagrams showing a well site with an example drilling rig to drill an example multilateral well. FIG. 1C is a schematic diagram showing a fracturing system implemented at the well site of FIGS. 1A and 1B. FIGS. 2A and 2B are schematic diagrams showing the well site with an example service rig to perform well operations (e.g., fracturing) in an example multilateral well. FIG. 3 is a flowchart of an example process 300 to form a multilateral well. The operations of process 300 are described below with reference to the schematic diagrams shown in FIGS. 1A, 1B, 2A and 2B.

At 302, a main wellbore is formed by drilling a subterranean zone using a drilling rig. FIG. 1A is a schematic diagram showing an example drilling rig 10 to form a main wellbore 112 of a multilateral well. The drilling rig 10 is a full-sized rig for performing primary and/or directional drilling operations. In some implementations, the drilling rig 10 located at or above the surface 12 rotates a drill string (not shown) disposed in the wellbore 110 below the surface 12. The drill string typically includes drill pipe and drill collars that are rotated to transfer down the wellbore 110 to a drill bit (not shown) or other downhole equipment attached to a distal end of the drill string. The drilling rig 10 includes surface equipment 14 to rotate the drill string and the drill bit as the drill bit bores into the subterranean zone, which includes a formation, a portion of a formation, or multiple formations (e.g., a first formation 102, a second formation 104, a third formation 106). In some implementations, the drilling rig 10 can be operated to form a main wellbore 112 in the third formation 106 off the subterranean zone. The main wellbore 112 can be a vertical wellbore, a horizontal wellbore, or an angular wellbore. In some implementations, the main wellbore 112 can extend across multiple formations in the subterranean zone.

At 304, a downhole deflector tool 140 is installed near an entrance 113 to a lateral wellbore 114 in the multilateral well. In some implementations, the downhole deflector tool 140 can be a combination whipstock and completion deflector (hereinafter "whipstock"), e.g., the combination whipstock and completion deflector described in U.S. Pat. No. 8,376,066. The whipstock can be positioned near an entrance to the lateral wellbore and operated to direct an assembly from the surface either toward the main wellbore or toward the lateral wellbore. In some implementations, the downhole deflector tool 140 (i.e., the whipstock) can include a surface to divert a cutting tool (e.g., a mill, a drill bit, or both) to create the lateral wellbore 114 and that can divert a completion string for completing the lateral wellbore 114 without requiring the assembly or part of the assembly from being removed from the wellbore 110 prior to the completion string being diverted. In some instances, the drill bit is lowered into the wellbore 110 and is deflected by the downhole deflector tool 140 toward the entrance 113. In some instances, the portion of the wellbore 110 including and/or surrounding the entrance 113 can be cased prior to installing the downhole deflector tool 140 near the entrance 113. In such instances, a mill is lowered into the wellbore 110 to form a window in the casing at the entrance 113. Subsequently, the drill bit is lowered.

A surface of the combination whipstock deflector is suitably tapered to allow for milling or drilling out of a window in a casing string, for drilling the lateral wellbore 114, for deploying a lateral leg of a completion string such as a junction and to enable fluid communication with the main well bore. For example, the assembly includes one or more mechanisms for plugging and sealing the main wellbore 112. The assembly also protects against debris that are generated downhole. In some implementations, the assembly provides a continuous, sealed flow path to lower completions in the main wellbore 112 and provide access to intervention through the main wellbore 112. The surface is recoverable using external mechanisms (e.g., a die collar and an overshot, or other external mechanisms) and/or internal mechanisms (e.g., a running/retrieving tool and a spear, or other internal mechanisms).

At 306, a lateral wellbore is formed off the main wellbore by drilling the subterranean zone using the drilling rig. FIG. 1B is a schematic diagram showing the example drilling rig 110 to form the lateral wellbore 114 of the multilateral well. In some implementations, one or more cutting tools (e.g., mills and/or drills) are lowered into the wellbore 110 (e.g., through a casing string) and are deflected by a surface of the downhole deflector tool 140 toward the entrance 113. In instances in which the portion of the wellbore 110 around the entrance 113 is cased, the cutting tools mill through the sidewall of the casing to form a window through which the cutting tools can create the lateral wellbore 114 in the second formation 104. The lateral wellbore 114 can, alternatively or in addition, be drilled through one or more other formations in the subterranean zone. The cutting tools can be removed from the lateral wellbore 114 and a completion string lowered into the wellbore 110. At least a portion of the completion string can be deflected by the surface of the downhole deflector tool 140 toward the lateral wellbore 114 to complete the lateral wellbore 114. One or more additional lateral wellbores can be formed in the subterranean zone using the drilling rig 10 by implementing techniques similar to those described above at other positions in the wellbore 110.

At 308, the drilling rig is removed after forming the multilateral well. Removing the drilling rig includes removing the drilling rig off the well site in which the multilateral well is being drilled, the well site including an area to position the drilling rig and associated equipment for forming the multilateral well. That is, the possession of the drilling rig is relinquished such that cost associated with possessing the drilling rig ceases to be incurred. The downhole deflector tool 140 is left in place in the wellbore.

At 310, a wellbore (e.g., either the main wellbore 110 or the lateral wellbore 112) is accessed using a member expandable in response to pressure to sizes that permit or prevent access to the wellbore. FIG. 2A is a schematic diagram showing a service rig 200 to access the lateral wellbore 114. Relative to a drilling rig, the service rig 200 is smaller and mobile. For example, all components of a service rig can be loaded onto a single truck and transported between well sites. Drilling rigs, on the other hand, include multiple components, which, upon completion of drilling, are dismantled and transported away from the well site on multiple trucks. In some implementations, the service rig 200 is operated to lower a string 202 into the wellbore 110. The member 204 that is expandable in response to pressure (e.g., from fluid flowed through the member 204) to sizes that permit or prevent access to the lateral wellbore 114 is attached to a distal end of the string 202. As the member 204 is lowered into the wellbore 110, the member 204 is diverted by the downhole deflector tool 140 into the lateral wellbore 114.

Figure 4:
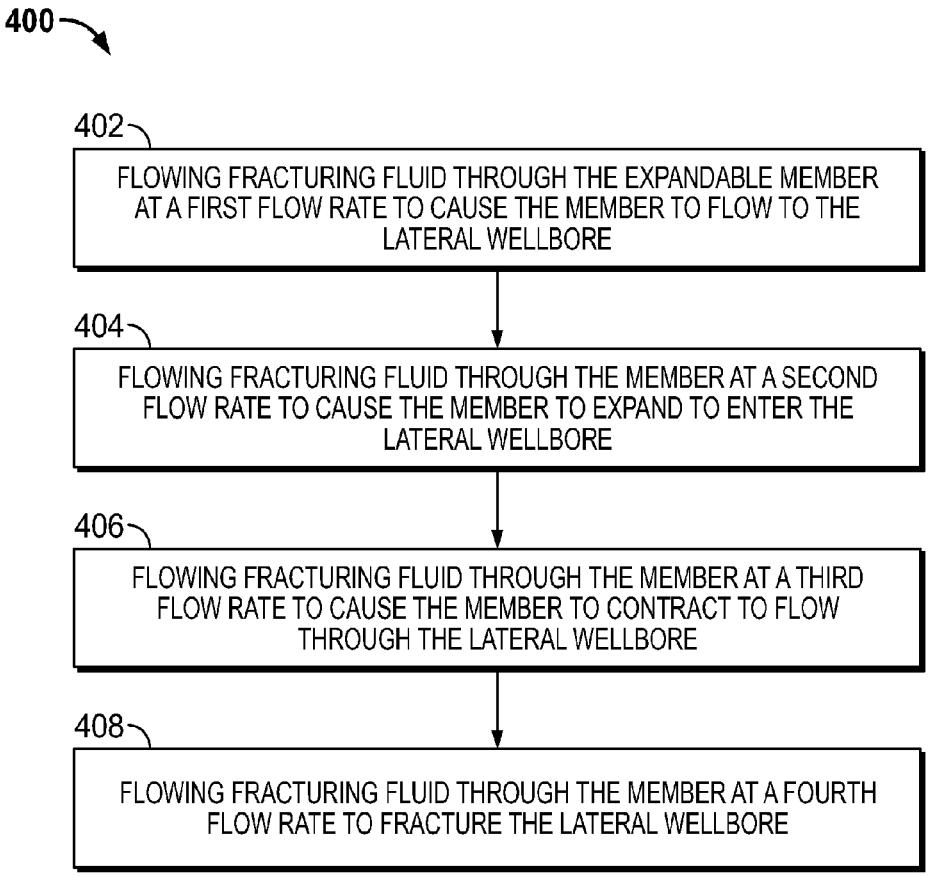
FIG. 4 is a flowchart of an example process to access a lateral wellbore in a multilateral well.

FIG. 4 is a flowchart of an example process 400 to access the lateral wellbore 114 (or the main wellbore 112) in the multilateral well using the member 204. In some implementations, the member 204 can include a bullnose assembly having parameters that are adjustable downhole to selectively enter one or more legs of a multilateral wellbore, all in a single trip downhole. The parameters of the bullnose assembly that can be adjusted while downhole can include a length, diameter, combination of them, or other parameters. The adjustable parameters can allow a well operator to intelligently interact with deflector assemblies arranged at multiple junctions in the multilateral wellbore. Each deflector assembly can include upper and lower deflectors spaced from each other by a predetermined distance. At a desired deflector assembly, the bullnose assembly can be actuated to alter its length with respect to the predetermined distance such that it may be deflected or guided as desired either into a lateral wellbore or further downhole within the main wellbore. Similarly, the lower deflector of each deflector assembly can include a conduit that exhibits a predetermined diameter. At the desired deflector assembly, the bullnose assembly can be actuated to alter its diameter with respect to the predetermined diameter such that it can be directed either into the lateral wellbore or further downhole within the main wellbore. Accordingly, well operators may be able to selectively guide a bullnose assembly into multiple legs of the wellbore by adjusting parameters of the bullnose assembly on demand while downhole. The bullnose assembly can be actuated by applying hydraulic pressure to the assembly. For example, a hydraulic fluid can be applied from a surface location through a conveyance (e.g., coiled tubing, drill pipe, production tubing, or other conveyance) coupled to the bullnose assembly. The bullnose assembly can, alternatively or in addition, be actuated using mechanical and/or electrical mechanisms. An example bullnose assembly is described in PCT/US13/52100 filed on Jul. 25, 2013 and entitled "Expandable and Variable-Length Bullnose Assembly for use with a Wellbore Deflector Assembly."

At 402, fluid is flowed through the member 204 at a first flow rate to cause the member to travel to the lateral wellbore 114 without expanding. For example, a fracturing system is operated to flow fracturing fluid through the member 204 to allow the member 204 to circulate without expanding toward the lateral wellbore 114. As the member 204 travels through the wellbore 110, the downhole deflector tool 140 diverts the member 204 toward the lateral wellbore 114. At 404, fluid is flowed through the member 204 at a second flow rate that is greater than the first flow rate. For example, the fracturing system is operated to flow the fracturing fluid through the member 204 at the second flow rate at which the member 204 expands to enter the lateral wellbore 114. At 406, fluid is flowed through the member 204 at a third flow rate to cause the member to contract to flow through the lateral wellbore 114. For example, the fracturing system is operated to flow the fracturing fluid through the member 204 at the third flow rate that is less than the second flow rate to allow the member 204 to contract, permitting the member 204 to enter sealbores or pass restrictions in the lateral wellbore 114. At 408, fluid is flowed through the member 204 at a fourth flow rate to fracture the lateral wellbore 114. For example, the fracturing system is operated to flow the fracturing fluid at the fourth flow rate that is greater than the third flow rate, causing the member 204 to contract but allowing the fracturing fluid to pass to fracture the lateral wellbore 114. In some implementations, the fourth flow rate can be the highest of the four flow rates at which the fracturing fluid is flowed through the member 204.

In some implementations, the member 204 is a bullnose assembly including a bullnose. The bullnose assembly is operable to adjust various parameters of the assembly while downhole such that the assembly can selectively enter multiple legs of the multilateral well, all in a single trip downhole. The parameters of the bullnose assembly that are adjustable while downhole include the assembly's length, diameter, combinations of them, or other parameters. In some implementations, the bullnose in the bullnose assembly can be a full bullnose, while in others, it need not be a full bullnose. Instead, the bullnose can include a through bore and can expand radially on the outer diameter only. The bullnose can function such that alternating sequences of flow or pressure about a certain rate can expand or not expand the bullnose. Such an expanding bullnose can allow the same string to be used on one trip to enter the main wellbore 112 below the downhole deflector tool 140 or the lateral wellbore 114 for performing a fracture treatment.

In some implementations, the member 204 is a cutting tool, e.g., a mill or bit with blades that expand due to flow or pressure. In such implementations, the cutting tool can operate as its own expanding bullnose. The cutting tool and coil tubing assembly can be positioned above the downhole deflector tool 140. The cutting tool can then be expanded, e.g., by pressure or flow, so that the outer diameter of the cutting tool expands to become too large to pass through the downhole deflector tool 140 and is deflected into the lateral wellbore 114. In the lateral wellbore 114, the cutting tool can be either be left in the expanded condition or contracted to a diameter so that the plugs and ball/ballseats in the lateral wellbore 114 can be milled.

Example techniques were described above to access the lateral wellbore 114 before accessing the main wellbore 112. In some implementations, the main wellbore 112 can be accessed before accessing the lateral wellbore 114 by implementing techniques similar to those described above with reference to FIG. 4 and process 400. For example, the downhole deflector tool 140 (e.g., a combination whipstock deflector) can include a through hole 116 through which the member 204 (e.g., the bullnose assembly or the cutting tool) can be passed to access the main wellbore 112. In some implementations, the downhole deflector tool 140 (e.g., the combination whipstock deflector), which is positioned at the entrance 113 to the lateral wellbore 112, can be plugged with a drillable material 206. Because the drillable material 206 blocks (e.g., completely or partially) access below the downhole deflector tool 140, the downhole deflector tool 140 deflects the member 204 into the lateral wellbore 114. The seal formed by the drillable material 206 can, alternatively or in addition, limit/prevent debris from falling into the main wellbore 112 below the downhole deflector tool 140 during well operations, e.g., milling the casing exit, drilling the lateral wellbore 114, or other well operations performed at or above the downhole deflector tool 140. To access the main wellbore 112 before accessing the lateral wellbore 114, coil tubing that includes a cutting tool and a motor can be lowered to the downhole deflector tool 140. The cutting tool can drill through the drillable material 206 permitting access to the main wellbore 114.

After forming the main wellbore 112 and the lateral wellbore 114 (and other lateral wellbores) of the multilateral well and removing the drilling rig from the well site, fracture treatments can be performed in the multilateral well. At 312, a fracturing system can be operated to perform a fracture treatment on the lateral wellbore 114, and, at 314, the lateral wellbore 112 can be opened for production. For example, the fracture system can include instrument trucks 25, pump trucks 27 and other equipment. The fracture system can fracture the subterranean zone, e.g., so that injection fluids can be propagated through the open fractures. A fracture treatment can include a mini fracture test, a regular or full fracture treatment, a follow-on fracture treatment, a re-fracture treatment, a final fracture treatment, or another type of fracture treatment. Alternatively, at 316, the fracturing system can be operated to perform a fracture treatment on the main wellbore 112, and, at 318, the main wellbore 112 can be opened for production. In other words, either the main wellbore 112 or the lateral wellbore 114 (or any of the lateral wellbores) can be first selected for performing the fracture treatment. FIG. 2B is a schematic diagram showing that fracture treatments have been performed in the main wellbore 112 and in the lateral wellbore 114.

In some implementations in which the fracture treatment is performed on the main wellbore 112 before the lateral wellbore 114, the main wellbore 112, in which the fracture treatment has been performed, can be temporarily blocked with a blocking mechanism, e.g., a flapper valve, a ball valve, or other blocking mechanism, that can be shifted to a closed state after the fracture treatment is performed and the fracture string pulled out of the main wellbore 112. Then, the lateral wellbore 114 can be lined across the downhole deflector tool 140 (e.g., the drilling whipstock). To do so, in some implementations a system similar to a lateral liner drop-off tool can be implemented. A FlexRite® Multibranch Inflow Control (MIC) System offered by Halliburton Energy Services, Inc. is an example of a lateral liner drop-off tool. In such implementations, the lateral liner can be run and dropped in the lateral wellbore 114. If a retrieving tool to retrieve the downhole deflector tool 140 (e.g., a whipstock) was ran below the lateral liner drop-off, then the lateral liner drop-off and the retrieving tool can be pulled back into the main wellbore 112. The retrieving tool can be used to engage and retrieve the whipstock from the wellbore 110 on the same trip as running the lateral liner. Once the whipstock is retrieved, a completion deflector (e.g., a FlexRite® completion deflector, Halliburton Energy Services, Inc., Houston, Tex.) can be run in the well to regain access to the lateral wellbore 114.

In some implementations, a self-aligning latch and latch coupling system or a non-rotating latch system or similar system can be operated to perform well operations with a work over rig instead of a drilling rig after the whipstock has been retrieved. Examples of self-aligning latch and latch coupling systems can be found in U.S. Pat. No. 8,678,097 and/or U.S. Pat. No. 8,376,054. Doing so can offer financial savings. For example, the deflector can provide the ability to re-enter the lateral wellbore 114 to perform fracture treatment with a fracture string. The deflector can also be operated to deflect a seal stinger into the lateral liner seal bore and allow for the fracture treatment to be performed. The deflector can include a solid bore or a bore large enough for running and retrieving the deflector with the retrieving tool. Alternatively or in addition, the deflector can include a larger bore allowing the deflector to be left in the well and to produce through the deflector. To retrieve the deflector, and thus regain access to the main well bore 112 after the fracture treatment in the lateral wellbore 114, a shifting tool can be run at or near the bottom of the deflector to open the valve that is isolating the main wellbore 112.

Figure 5A:
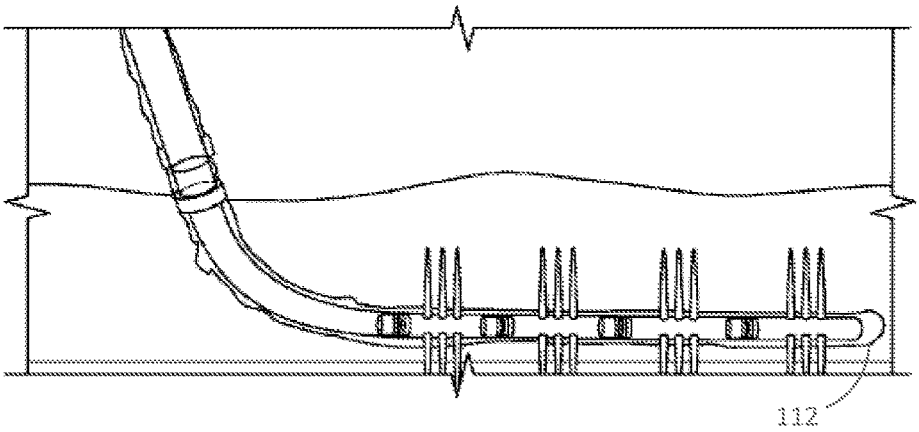
FIGS. 5A-5I are schematic diagrams showing a multilateral well being formed in a subterranean zone.

FIGS. 5A-5I are schematic diagrams showing a multilateral well formed in a subterranean zone in a limited number of trips. FIG. 5A is a schematic diagram showing a latch coupling run as part of the casing. The main wellbore 112 has been drilled and fractured. The fracturing system can be, e.g., a plug and perf system. A plug and perf system includes perforating guns and composite frac plugs deployed via wireline in the wellbore. To fracture the main wellbore 112, the plug and perf system is operated to perforate each zone, fracture the perforated zone, and then isolated from the zones above by setting a plug. For example, perforating guns can be pumped down to reach the desired depth. At the depth, the plug is set. The guns are then pulled back up-hole and detonated at various depths along the interval.

In some implementations, the zones can be fractured with stimulation sleeves instead of plug and perf system. Such alternative systems can be run inside a liner or in the wellbore. The system includes ported sleeves installed between isolation packers on a single liner string. Packers isolate the wellbore into stages. Balls can be dropped from the surface to open a stimulation sleeve and to isolate the zones below as each subsequent zone is fractured. For example, a ball dropped into the fluid and pumped down the string will seat in the mechanical sleeve. This action will open the sleeve exposing the ports and diverting the fluid to the formation, which creates a hydraulic fracture within the isolated zone. The system can be operated by pumping progressively larger-sized balls and operating sleeves from the toe of the wellbore to the heel. The wellbore can be cleaned out by flow back to the surface, which returns fluid and solid particles. The balls and ball seats can be drilled out with coiled tubing. This fracturing process adds no additional trips other than fracturing besides running a latch coupling into the wellbore 110. After the fracture treatment is performed on the last zone, the fracture string can be pulled up to the latch coupling to circulate out of the main wellbore 112, any well proppant or debris that may have dropped into the latch coupling. If needed, a separate latch clean out trip can be used to clean the latch coupling and to confirm latch coupling operation.

Figure 5B:
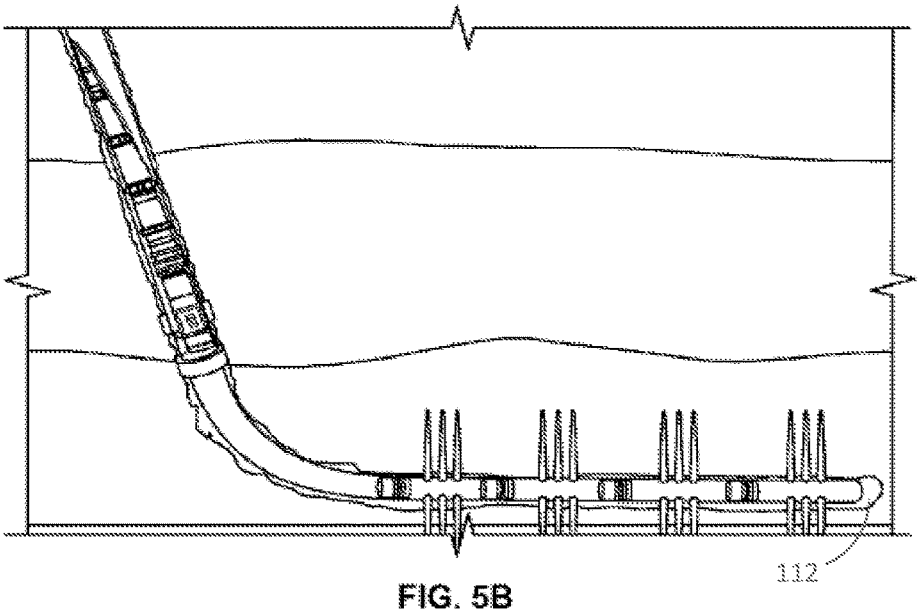
Figure 5C:
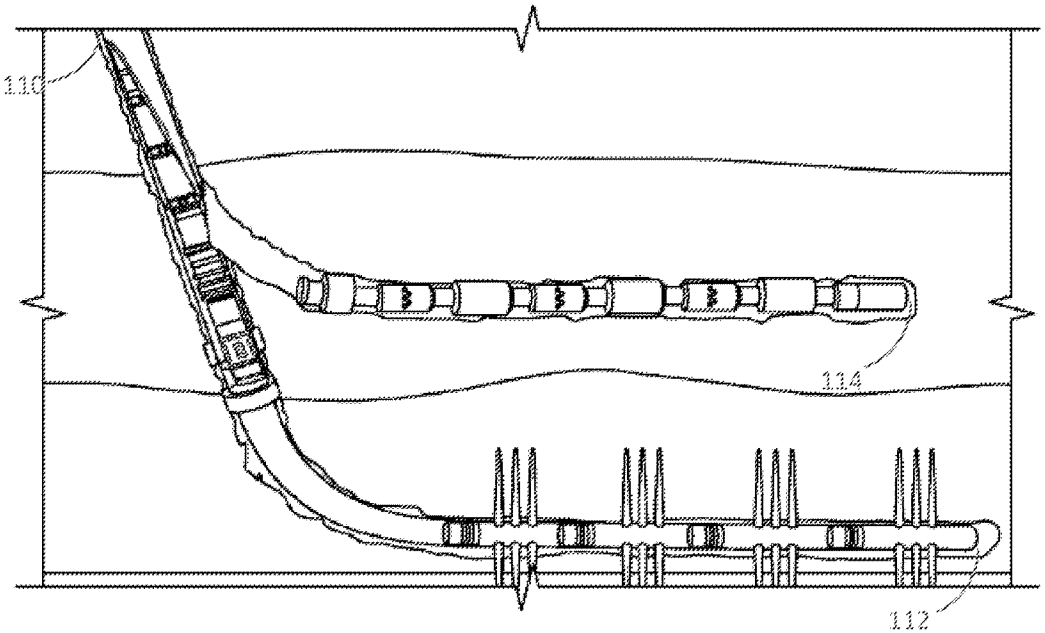
Figure 5D:
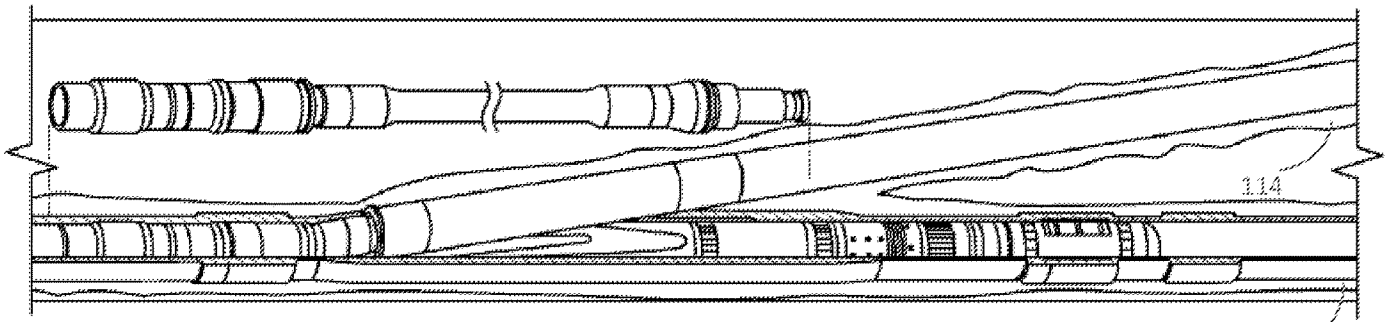

FIG. 5B is a schematic diagram showing a whipstock run to allow for milling the casing exit and drilling the lateral wellbore 114. This operation can add one multilateral related trip to performing the fracture treatment. The whipstock can include a hollow bore temporarily plugged with an easily milled/drilled material (e.g., composite, cement, or other easily milled/drilled material), as described above. FIG. 5C is a schematic diagram showing a lateral liner being run in. Running in the lateral liner does not require an additional trip above the normal single lateral operations. FIG. 5D shows a cemented liner that can be run instead of a dropped-of liner if a fully cemented liner is implemented. This operation also does not add an additional trip above single lateral operations.

Figure 5E:
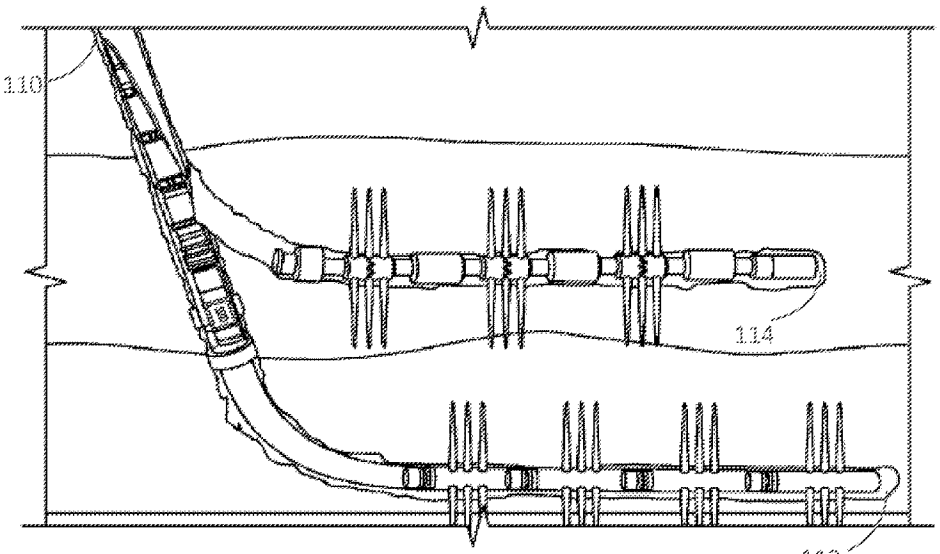

FIG. 5E is a schematic diagram showing a fracture treatment performed in the lateral leg, which excludes an additional multilateral trip. Then, the lateral leg ball seats (in stimulation sleeves implementations) can be milled-up on coil tubing resulting in the lateral wellbore 114 being live without an additional multilateral-related trip. The coiled tubing can be run with a service rig and doesn't need the significantly larger and less portable drilling rig. Then, the same coil tubing strip can be used to drill-up the temporary filler in the bore of the whipstock. The coil tubing can continue down to mill-out the balls/ball seats of the main wellbore 112 to start producing out of the main wellbore 112. The whipstock can be left in the wellbore and produced through. In some situations, one or two additional trips may be made to clean and survey the latch coupling in addition to those made during multilateral well forming operations. In situations in which a combination whipstock/deflector is implemented instead of a whipstock, a completion can be run to isolate the junction and production can be through the whipstock. Doing so can involve an optional multilateral-related trip.

Figure 5F:
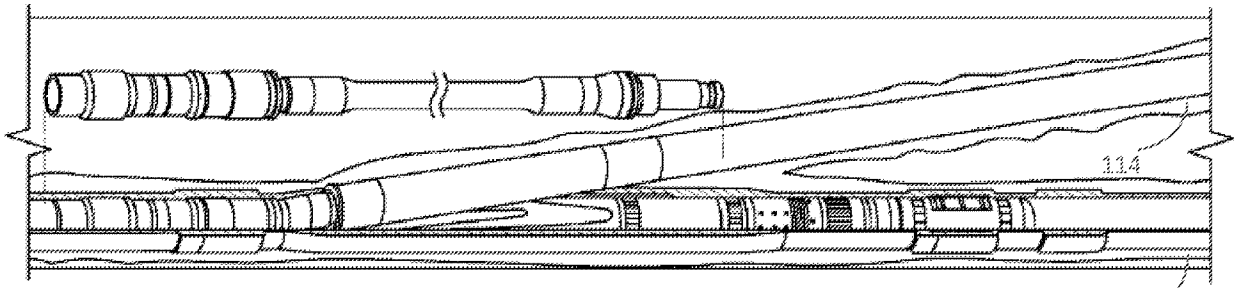
Figure 5G:
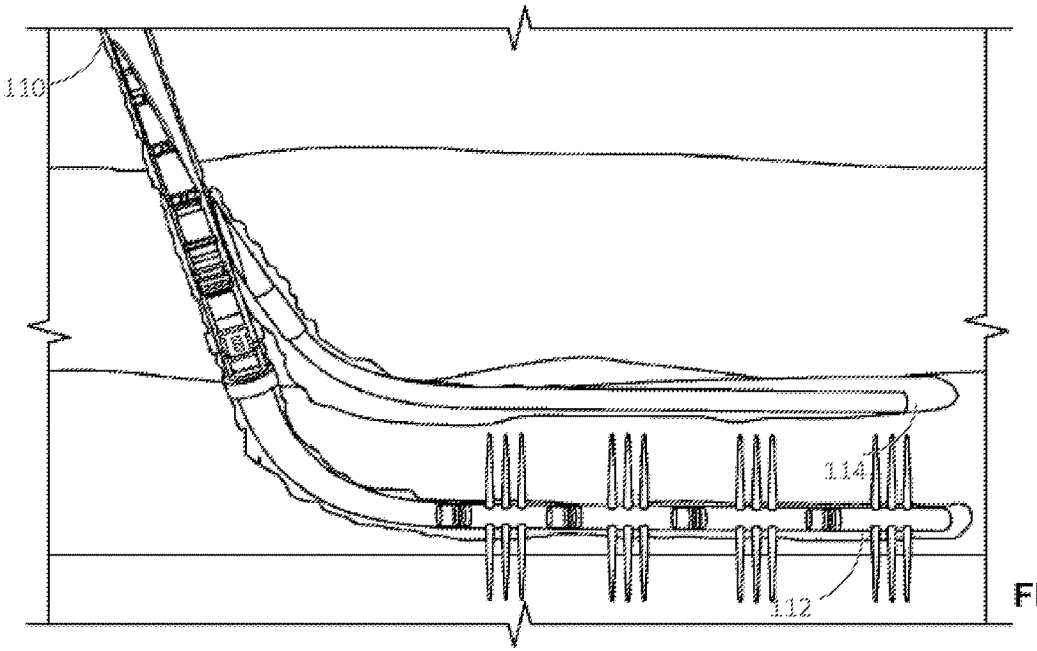
Figure 5H:
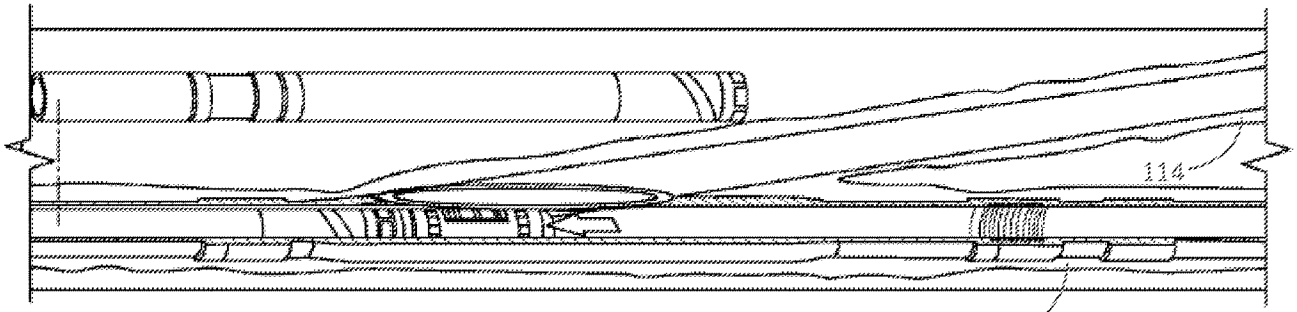
Figure 5I:
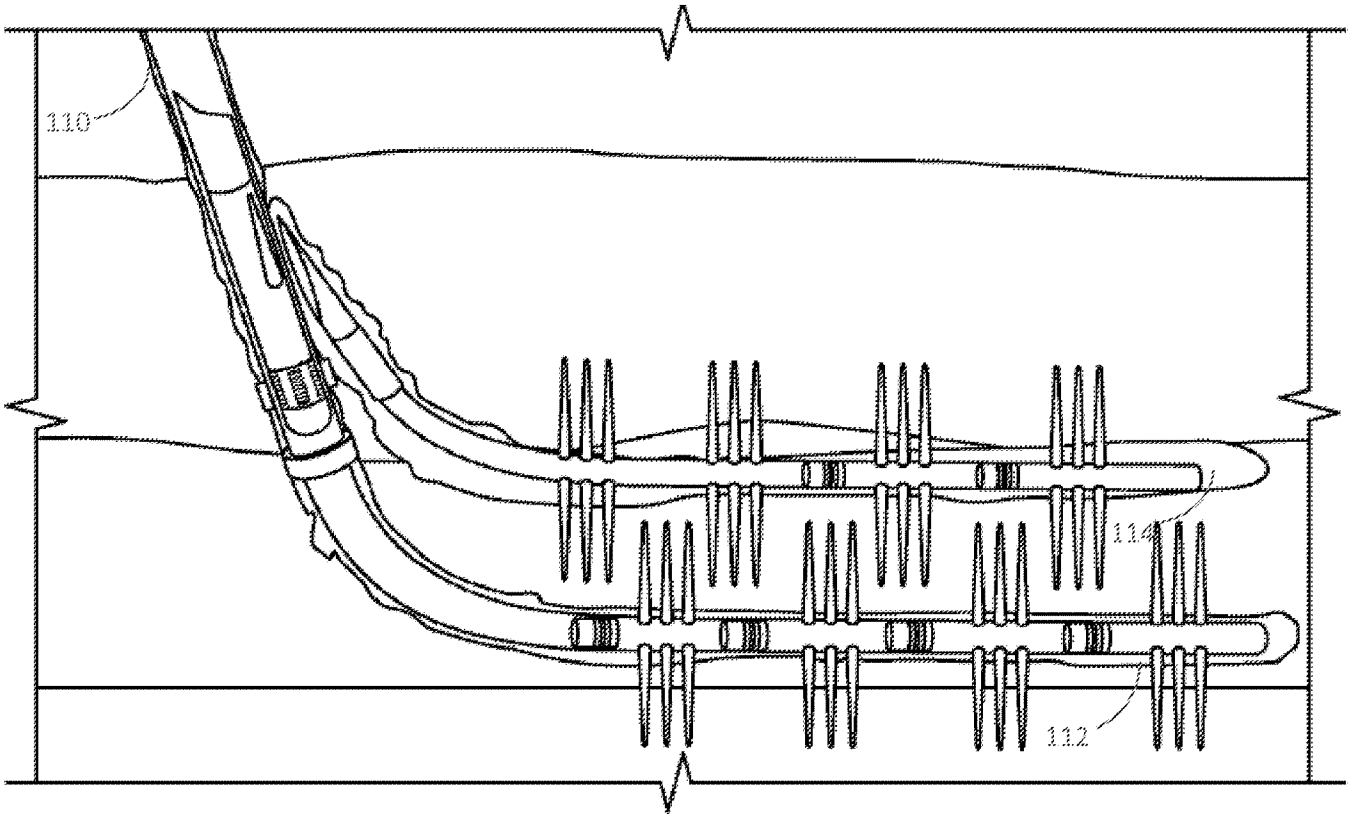

FIG. 5F is a schematic diagram showing a lateral liner run and cemented for a fully cemented lateral liner. FIG. 5G is a schematic diagram showing a lined lateral wellbore 114 that has been cemented but in which a fracture treatment has not yet been performed. A trip is made to wash over the whipstock. FIG. 5H is a schematic diagram showing a work over whipstock to regain access to the lateral wellbore 114. Alternatively, a deflector or diverter can be run to access the lateral wellbore 114 in an additional multilateral-related trip. FIG. 5I is a schematic diagram showing a fractured lateral wellbore 114. The fracture treatment can be performed in the lateral wellbore 114 with the work over whipstock in place, which can operate as a deflector. As described above, the lateral leg ball seats (when stimulation sleeves are implemented) or plugs can be milled and/or drilled-up on coil tubing resulting in the lateral wellbore 114 being live without a multilateral-related trip. Then, the same coil tubing can be used to drill-up the temporary plug in the work over whipstock. The coil tubing can continue down to mill-out the balls/ball seats of the main wellbore 112 to start producing out of the main wellbore 112. The work over whipstock can be left in the wellbore and produced through.

The example operations described above include three total multilateral-related trips and possibly four trips if an optional trip to clean latch coupling is required, latch coupling surveying trip is performed for a fractured multilateral well. A trip would be added if the lateral wellbore 114 is to be cemented. Leaving the whipstock (or the work over whipstock) in the well and producing through the whipstock (or the work over whipstock) inside the wellbore can limit the number of multilateral-related trips to be made into the multilateral well.

Certain aspects of the subject matter described here can be implemented as a method for forming a multilateral well. Using a drilling rig, a subterranean zone is drilled to form a main wellbore. Using the drilling rig, a whipstock is set in the main wellbore. Using the drilling rig, the subterranean zone is drilled to form a lateral wellbore off the main wellbore. The drilling rig is removed after forming a multilateral well including the main wellbore and the lateral wellbore, leaving the whipstock in the main wellbore. Using a fracturing system, a fracture treatment is performed on the lateral wellbore.

This, and other aspects, can include one or more of the following features. Removing the drilling rig can include removing the drilling rig off a well site in which the multilateral well this being drilled. The well site can include an area to position the drilling rig and associated equipment for forming the multilateral well. Production can be performed through the whipstock. A fracture treatment can be performed on the main wellbore either before or after performing the fracture treatment on the lateral wellbore. To perform the fracture treatment on the lateral wellbore, the lateral wellbore can be accessed using a member expandable in response to pressure to sizes that permit or prevent access to the lateral wellbore. To access the lateral wellbore using the member, fracturing fluid can be flowed through the member using the fracturing system. The fracturing fluid can be flowed through the member at a first flow rate to cause the member to flow to the lateral wellbore without expanding. The fracturing system can be flowed through the member at a second flow rate that is greater than the first flow rate. The second flow rate causes the member to expand to enter the lateral wellbore. The member can be either a bullnose or the cutting tool. Using a fracturing system, a fracture treatment can be performed on the main wellbore before performing the fracture treatment on the lateral wellbore. The main wellbore can be sealed after performing the fracture treatment using a completion deflector. The main wellbore can be opened for production after performing the fracture treatment on the main wellbore. The main wellbore can include a casing sleeve or a plug. Opening the main wellbore for production can include sliding a casing sleeve through the main wellbore or releasing the plug. The lateral wellbore can be opened for production after performing the fracture treatment. The lateral wellbore can include a casing sleeve or a plug. Opening the lateral wellbore for production can include sliding a casing sleeve through the lateral wellbore or releasing the plug.

Certain aspects of the subject matter described here can be implemented to form a multilateral well. A well is formed in a subterranean zone using a drilling rig. The well includes a main wellbore and a lateral wellbore formed off the main wellbore. The drilling rig is removed after forming the multilateral well. A whipstock is set in the main wellbore. A fracture treatment is selectively performed on either the main wellbore or the lateral wellbore using a fracturing system.

This, and other aspects, can include one or more of the following features. Removing the drilling rig can include removing the drilling rig off a well site in which the multilateral well is being drilled. The well site can include an area to position the drilling rig and associated equipment for completing the multilateral well. Production can be performed through the main wellbore. Selectively performing the fracture treatment on either the main wellbore or the lateral wellbore can include performing the fracture treatment on the main wellbore before performing the fracture treatment on the lateral wellbore. The whipstock can include a drillable material that prevents access to the main wellbore. Performing the fracture treatment on the lateral wellbore before performing the fracture treatment on the main wellbore can include accessing the main wellbore. To do so, coil tubing can be lowered toward the whipstock. The coil tubing can include a cutting tool. The drillable material can be drilled using the cutting tool included in the coil tubing.

Certain aspects of the subject matter described here can be implemented to form a multilateral well. A main wellbore is formed using a drilling rig. A whipstock is installed in the main wellbore near an entrance to a lateral wellbore from the main wellbore. Using the drilling rig, the lateral wellbore is formed off the main wellbore at the entrance. The drilling rig is removed after forming the main wellbore and the lateral wellbore. The main wellbore or the lateral wellbore is selectively accessed using the whipstock. A fracture treatment is performed on the main wellbore or the lateral wellbore in response to the selective accessing.

This, and other aspects, can include one or more of the following features. Removing the drilling rig can include removing the drilling rig off a well site in which the multilateral well is being drilled. The well site can include an area to position the drilling rig and associated equipment for completing the multilateral well. Performing the fracture treatment on the main wellbore or collateral wellbore can include performing the fracture treatment on the lateral wellbore. To do so, the fracturing system can flow fracturing fluid through an expandable member first at a flow rate to cause the member to flow to the lateral wellbore without expanding, and second at a second flow rate that is greater than the first flow rate, the second flow rate to cause the member to expand to enter the lateral wellbore.

A number of implementations have been described. Nevertheless, it will be understood that various modifications may be made without departing from the spirit and scope of the disclosure.

The invention claimed is:

1. A method comprising:

drilling, using a drilling rig, a subterranean zone to form a main wellbore;

setting, using the drilling rig, a whipstock in the main wellbore;

drilling, using the drilling rig and the whipstock, the subterranean zone to form a lateral wellbore off the main wellbore;

removing the drilling rig, after forming a multilateral well including the main wellbore and the lateral wellbore, leaving the whipstock in the main wellbore; and performing, using a fracturing system, a fracture treatment on the lateral wellbore, wherein performing the fracture treatment on the lateral wellbore includes;

accessing the lateral wellbore using a member expandable in response to pressure to sizes that permit or prevent access to the main wellbore;

flowing, using the fracturing system, fracturing fluid through the member at a first flow rate to cause the member to flow to the lateral wellbore without expanding; and flowing, using the fracturing system, the fracturing fluid through the member at a second flow rate that is greater than the first flow rate, the second flow rate to cause the member to expand to enter the lateral wellbore.

2. The method of claim 1, wherein removing the drilling rig includes removing the drilling rig off a well site in which the multilateral well is being drilled.

3. The method of claim 1, further comprising producing through the whipstock.

4. The method of claim 1, further comprising performing a fracture treatment on the main wellbore either before or after performing the fracture treatment on the lateral wellbore.

5. The method of claim 1, wherein the member is either a bullnose assembly or a cutting tool.

6. The method of claim 1, further comprising:

performing, using a fracturing system, a fracture treatment on the main wellbore before performing the fracture treatment on the lateral wellbore; and sealing the main wellbore after performing the fracture treatment on the main wellbore using a completion deflector.

7. The method of claim 6, further comprising opening the main wellbore for production after performing the fracture treatment on the main wellbore.

8. The method of claim 7, wherein the main wellbore includes a casing sleeve or a plug, and wherein opening the main wellbore for production comprises sliding a casing sleeve through the main wellbore or releasing the plug.

9. The method of claim 1, further comprising opening the lateral wellbore for production after performing the fracture treatment.

10. The method of claim 9, wherein the lateral wellbore includes a casing sleeve or a plug, and wherein opening the lateral wellbore for production comprises sliding a casing sleeve through the lateral wellbore or releasing the plug.

11. A method comprising:

forming a well in a subterranean zone using a drilling rig, the well including a main wellbore and a lateral wellbore formed off the main wellbore;

setting a whipstock in the main wellbore;

removing the drilling rig after forming the multilateral well, leaving the whipstock in the main wellbore; and selectively performing a fracture treatment on either the main wellbore or the lateral wellbore using a fracturing system, wherein selectively performing the fracture treatment on either the main wellbore or the lateral wellbore includes;

accessing one of the main wellbore or the lateral wellbore using a member expandable in response to pressure to sizes that permit or prevent access to the other of the main wellbore or the lateral wellbore;

flowing, using the fracturing system, fracturing fluid through the member at a first flow rate to cause the member to flow to one of the main wellbore or the lateral wellbore without expanding; and flowing, using the fracturing system, the fracturing fluid through the member at a second flow rate that is greater than the first flow rate, the second flow rate to cause the member to expand to enter the one of the main wellbore or the lateral wellbore.

12. The method of claim 11, wherein removing the drilling rig includes removing the drilling rig off a well site in which the multilateral well is being drilled.

13. The method of claim 12, further comprising producing through the whipstock.

14. The method of claim 11, wherein selectively performing the fracture treatment on either the main wellbore or the lateral wellbore comprises performing the fracture treatment on the main wellbore before performing the fracture treatment on the lateral wellbore.

15. The method of claim 14, wherein the whipstock includes a drillable material that prevents access to the main wellbore, and wherein performing the fracture treatment on the lateral wellbore before performing the fracture treatment on the main wellbore comprises accessing the main wellbore by:

lowering coil tubing toward the whipstock, the coil tubing including a cutting tool; and drilling the drillable material using the cutting tool included in the coil tubing.

16. A method comprising:

forming, using a drilling rig, a main wellbore;

installing, in the main wellbore, a whipstock near an entrance to a lateral wellbore from the main wellbore;

forming, using the drilling rig, the lateral wellbore off the main wellbore at the entrance;

removing the drilling rig after forming the main wellbore and the lateral wellbore;

selectively accessing the main wellbore or the lateral wellbore using the whipstock; and performing a fracture treatment on the main wellbore or the lateral wellbore in response to the selective accessing, wherein performing the fracture treatment on the main wellbore or the lateral wellbore includes;

accessing one of the main wellbore or the lateral wellbore using a member expandable in response to pressure to sizes that permit or prevent access to the other of the main wellbore or the lateral wellbore;

flowing fracturing fluid through the member at a first flow rate to cause the member to flow to one of the main wellbore or the lateral wellbore without expanding; and flowing the fracturing fluid through the member at a second flow rate that is greater than the first flow rate, the second flow rate to cause the member to expand to enter the one of the main wellbore or the lateral wellbore.

17. The method of claim 16, wherein removing the drilling rig includes removing the drilling rig off a well site in which the multilateral well is being drilled, wherein the well site includes an area to position the drilling rig and associated equipment for completing the multilateral well.

* * * * *